US005595613A

United States Patent [19]

Hatano et al.

[11] Patent Number: 5,595,613

[45] Date of Patent: Jan. 21, 1997

[54] STEEL FOR GEAR, GEAR SUPERIOR IN STRENGTH OF TOOTH SURFACE AND METHOD FOR PRODUCING SAME

[75] Inventors: Atsumi Hatano, Komaki; Sadayuki Nakamura, Mie-gun; Makoto Yoshida, Hadano; Yoshio Okada, Atsugi; Takashi Matsumoto, Yokohama, all of Japan

[73] Assignees: Nissan Motor Co., Ltd., Yokohama; Daido Steel Co., Ltd., Aichi Prefecture, both of Japan

[21] Appl. No.: 400,225

[22] Filed: Mar. 7, 1995

[30] Foreign Application Priority Data

Mar. 9, 1994 [JP] Japan ..... 6-038282

[51] Int. Cl.[6] ..... C23C 8/22; C23C 8/32

[52] U.S. Cl. ..... 148/319; 148/206; 148/211

[58] Field of Search ..... 148/319, 211, 148/206, 586; 420/104

[56] References Cited

U.S. PATENT DOCUMENTS 3,640,114 2/1972 Foley, Jr. ..... 420/104

FOREIGN PATENT DOCUMENTS 1104065 5/1986 Japan ..... 148/319

406025823 2/1994 Japan ..... 148/319

OTHER PUBLICATIONS

Japanese Industrial Standard—Structural Steels with Specified Hardenability Bands—JIS G 4052 (1979).

JIS B 0601—Definitions and Designation of Surface Roughness—pp. 398–408.

*Primary Examiner*—Deborah Yee

*Attorney, Agent, or Firm*—Lowe, Price, LeBlanc & Becker

[57] ABSTRACT

A steel for gears consists essentially of 0.10–0.30 wt % of C, not more than 1.0 wt % of Si, not more than 1.0 wt % of Mn, 1.50–5.0 wt % of Cr, and balance including iron and impurity. A gear made by the steel forms a hardened surface layer by carbonizing-hardening-tempering or carbonitriding-hardening-tempering. The amount of C at the hardened surface layer is within a range 0.7 to 1.3 wt %, and the amounts of C, Si and Cr satisfies a relationship 5.5<3×C (wt %)+5.2×Si (wt %)+Cr (wt %). Therefore, the gear performs superior pitting-resistance and wear-resistance.

9 Claims, 5 Drawing Sheets

STEEL FOR GEAR, GEAR SUPERIOR IN STRENGTH OF TOOTH SURFACE AND METHOD FOR PRODUCING SAME

BACKGROUND OF THE INVENTION

1. Field of the Invention

The present invention relates to a steel which is used as a material for gears such as for a gear used in an automatic transmission, and relates to gears superior in strength of a tooth surface.

2. Description of the Prior Art

Conventionally, almost all typical gears have been made of chromium steel or chrome-molybdenum steel, such as JIS (Japan Industrial Standard) SCr 420H or JIS SCM 420H. Such gears have been treated by carburizing-hardening-tempering after forming in a gear-shape. Since the gears for automatic transmissions are required to have high strength on tooth surface so as to be durable to repeated friction under high contact pressure such as more than 2000 MPa, it have been necessary to apply some special treatments in the tooth surface, for example, a high-density carburizing method which strengthens the tooth surface by precipitating micro carbide in a surface layer, or a solid lubrication method which decreases the friction on the tooth surface by forming a solid lubrication film on the surface. However, these methods invite some problems such that it is necessary to take a long time for applying such treatments to the gears and therefore production cost is increased. On the other hand, although pitting resistance and wear resistance of the material are improved by increasing the amount of alloying elements, the hardness of the materiel is simultaneously increased. Therefore, the forgeability of the material is degraded. This shortens lives of machining tools for gear forming.

SUMMARY OF THE INVENTION

It is an object of the present invention to provide an improved steel which suppresses the degradation of machinability and is of a material of gears having a high resistance to temper softening.

It is another object of the present invention to provide an improved steel gear which improves pitting-resistance and wear-resistance while suppressing the degradation of forgeability and machinability of the steel.

It is further object of the invention to provide a method for producing the gear according to the invention.

According to the first aspect of the present invention, there is provided a steel for gears which consists essentially of carbon ranging from 0.10 to 0.30% by weight, silicon ranging not more than 1.0% by weight, manganese ranging not more than 1.0% by weight, chromium ranging from 1.50 to 5.0% by weight, and balance including iron and impurity.

According to the second aspect of the present invention, there is provided a gear made of a steel which consists essentially of carbon ranging from 0.1 to 0.3% by weight, silicon ranging not more than 1.0% by weight, manganese ranging not more than 1.0% by weight, chromium ranging from 1.5 to 5.0% by weight, and balance including iron and an impurity. A surface layer of the gear is hardened by one of carburizing-hardening-tempering and carbonitriding-hardening-tempering. A zone from surface to a depth of 0.1 mm of the hardened surface layer includes carbon ranging from 0.7 to 1.3% by weight and including C, Si and Cr so as to satisfy the equation: $5.5<3\times C$ (wt %)$+5.2\times Si$(wt %)+Cr(wt %).

According to the third aspect of the present invention, there is provided a method of producing a gear from a steel. The steel consists essentially of carbon ranging from 0.1 to 0.3% by weight, silicon ranging not more than 1.0% by weight, manganese ranging not more than 1.0% by weight, chromium ranging from 1.5 to 5.0% by weight, and balance including iron and an impurity. The method comprises the steps of forming the steel into a gear-like shape by one of forging and machining and hardening a surface layer of the shaped steel by one of carburizing-hardening-tempering and carbonitriding-hardening-tempering so that the surface layer from surface to a depth of 0.1 mm of the hardened surface layer includes carbon ranging from 0.7 to 1.3% by weight and includes carbon, silicon and chromium so as to satisfy the equation: $5.5<3\times C$ (wt %)$+5.2\times Si$(wt %)+Cr(wt %).

DETAILED DESCRIPTION OF THE INVENTION

According to the present invention, a steel for gears consists essentially of C (carbon) ranging from 0.10 to 0.30% by weight (wt %), Si (silicon) not more than 1.0% by weight, Mn (manganese) ranging not more than 1.0% by weight, Cr (chromium) ranging from 1.50 to 5.0% by weight, and balance including iron and impurity. Furthermore, according to the present invention, a gear made of the steel forms a hardened surface layer by carburizing-hardening-tempering or carbonitriding-hardening-tempering. The amount of C at the hardened surface layer is within a range 0.7 to 1.3%, and the amounts of C, Si and Cr satisfies a relationship $5.5<3\times C$ (wt %)$+5.2\times Si$ (wt %)+Cr (wt %).

The inventors of the present invention have pursued the research of steels for gears, on the basis of the fact that injuries on a tooth surface of gears by pitting and scoring are closely related to the temper softening resistance at a surface layer of the gear. In particular, in view of the fact that if a high contact pressure becomes over 2000 MPa the temperature at the surface layer portion of the tooth surface of the gear becomes higher than 300° C. due to the engagement of the gears in some cases, various researches and experiments were carried out. Consequently, the inventors found that the adequate addition of Si and Cr suppressed the temper softening of the material under such temperature, while suppressing the degradation of forgeability and mathinability, even if this material is treated by carburizing or carbonitriding. That is, it has been confirmed that pitting-resistance (life-time to pitting) and wear resistance (abrasion loss) of the steel for gears were improved by the adequate addition of Si and Cr.

Figure 1:
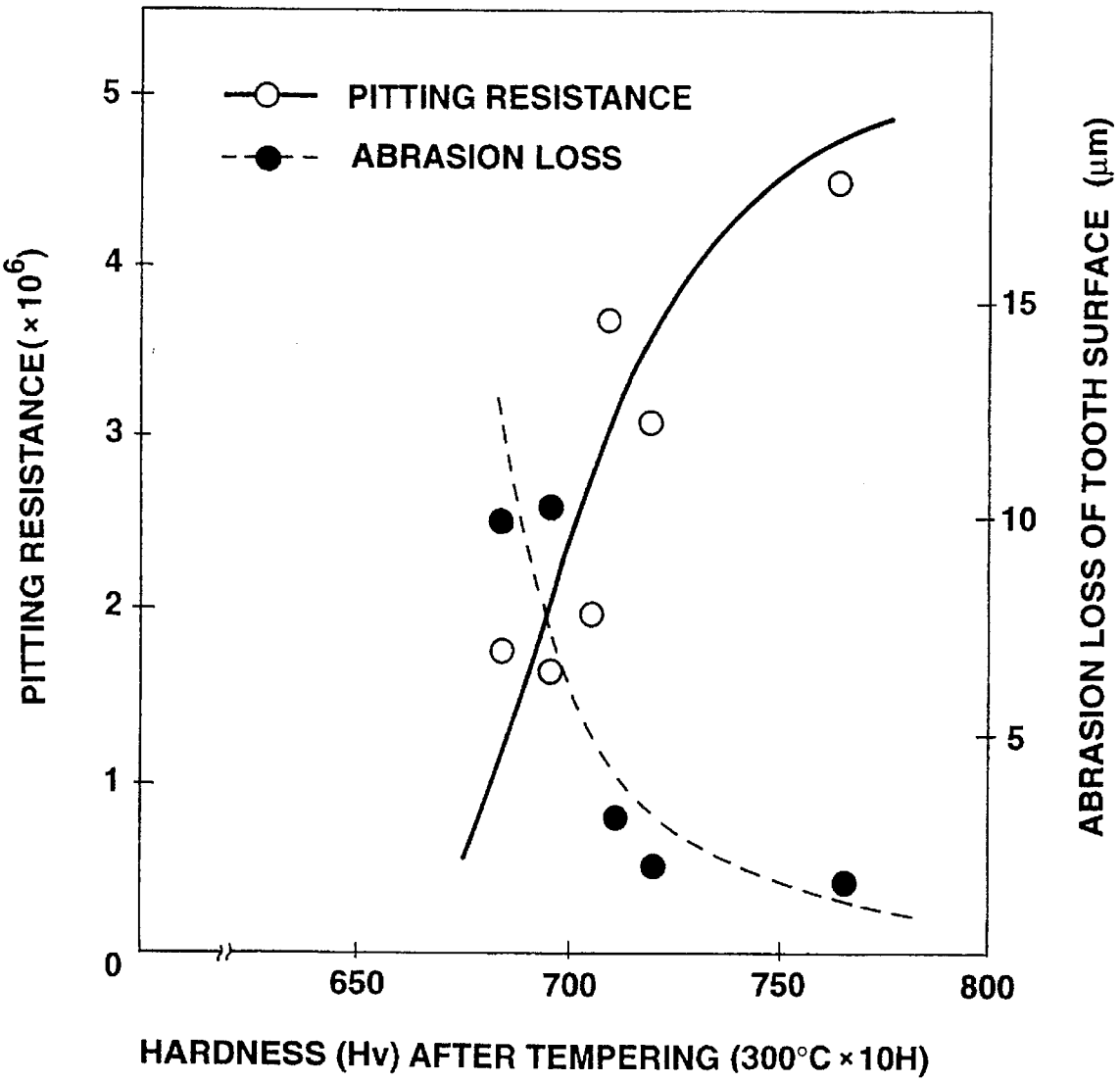
FIG. 1 is a graph which shows a relationship among a hardness, a life-time against pitting and an abrasion loss of the material treated by tempering 300° C.×10h.

FIG. 1 shows a relationship between Vickers hardness and pitting-resistance (life-time to pitting), and wear-resistance (abrasion loss) as to samples by 300° C.×10h. Vickers hardness was measured at a depth of 50 μm from surface of each sample. Samples for this experiment were formed from the material according to the present invention and from conventional material including a small amount of Si and Cr. As clear from the relationship shown in FIG. 1, the pitting resistance and the wear resistance were remarkably improved by suppressing the temper softening.

Figure 2:
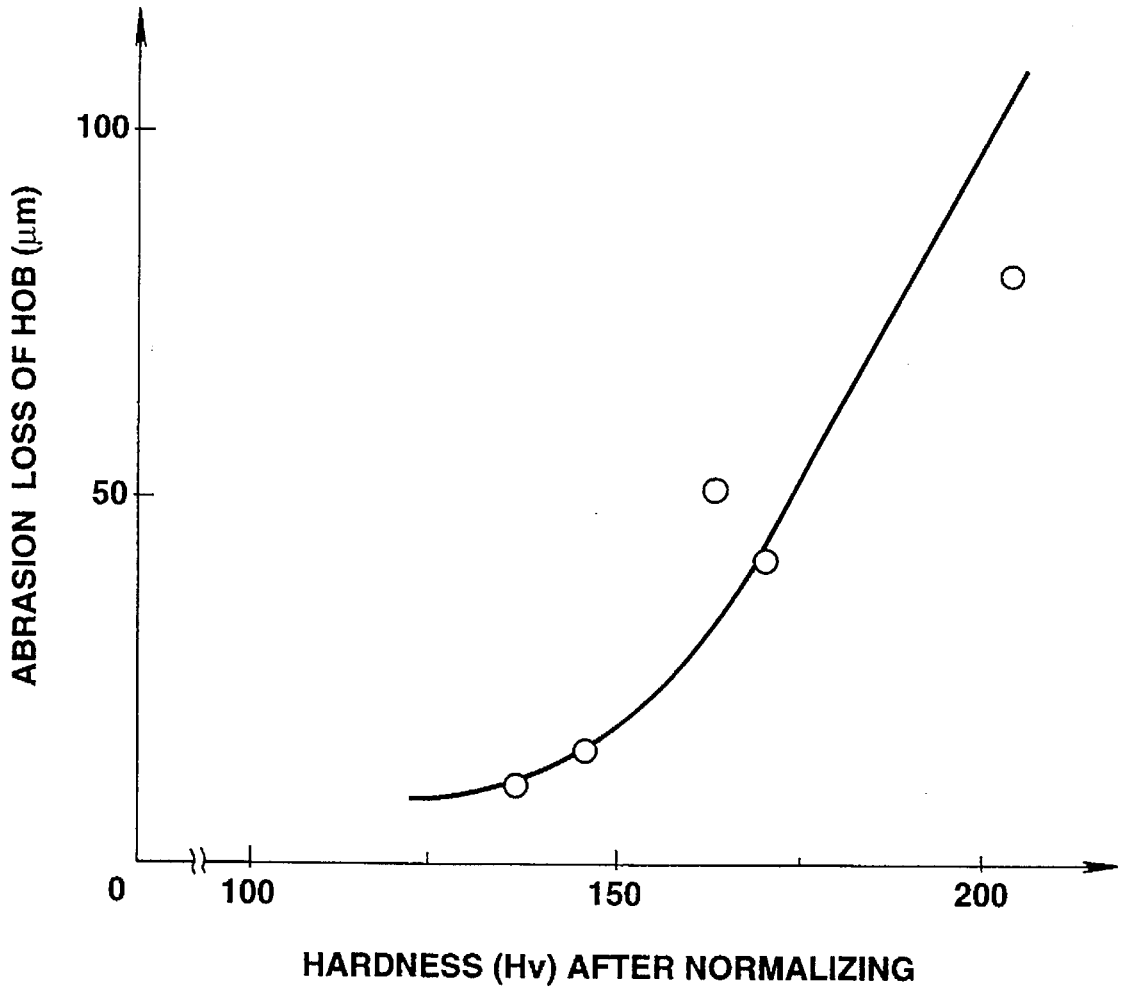
FIG. 2 is a graph which shows a relationship between a hardness of material treated by normalizing and pitting-resistance, and abrasion loss of tooth surface.

FIG. 2 shows a relationship between Vickers hardness of materials treated by normalizing and the abrasion loss of a hob of a machining tool. As clear from FIG. 2, the abrasion loss of the tool is largely increased by the increase of the hardness of the material before machining.

Reasons for defining the composition of the steel according to the present invention will be discussed hereinafter.

C:

C is an essential element for ensuring a deddendum strength of a gear. Although it is necessary that the amount of C is more than 0.10 wt % and particularly more than 0.15 wt %, the upper limit thereof is 0.30 wt % and often 0.25 wt %. Thus, the amount of C is decided to be within a range from 0.10 to 0.30 wt %.

Si:

Si improves the resistance to temper softening by suppressing the pearlite transformation in a manner to solid-solute Si in the matrix of the steel. In some cases, it is preferable that the amount of Si is more than 0.40 wt %. Even if the amount of Si exceeds 1.0 wt %, the obtained merits is saturated, and the cold forgeability, the machinability and the carburizability are degraded. Therefore, the amount of Si is decided to be within a range not more than 1.0 wt % and in some cases, within a range not more than 0.9 wt %.

Mn:

Mn effectively functions as a deoxidizer and a desulfurizer in melted steel. The machinability of the material is degraded due to the increase of the hardenability if the amount of Mn exceeds 1.0 wt %. Therefore, the amount of Mn is decided to be within a range not more than 1.0 wt %.

In some cases, within a range not more than 0.5 wt %.

Cr:

Cr is an important element for improving the resistance to the temper softening as is similar to Si. If the amount of Cr is less than 1.50 wt %, such resistance cannot be sufficient. Accordingly, the amount of Cr is to be not less than 1.5 wt %, and in some cases is to be not less than 2.0 wt %. However, if the amount of Cr becomes more than 5.0 wt %, the machinability is degraded and the cost thereof is increased. Therefore, the amount of Cr is decided to be within a range not more than 5.0 wt %, and in some cases, within a range not more than 4.0 wt %.

The amount of C in surface layer:

The hardness on a surface and the resistance to the temper softening are influenced by the amount of C at a surface, in particular in a zone from surface to a depth of 0.1 mm. If the amount of C is less than 0.7 wt %, the surface hardness is insufficient, and therefore the pitting-resistance and wear-resistance are lowered. If the amount of C becomes larger than 1.3 wt %, the precipitation of a network structure cementite is remarkably increased, and the toughness and grindability at a surface layer section are lowered. Therefore, the amount of C at a zone from surface to a depth of 0.1 mm is decided to be with in a range from 0.7 to 1.3 wt %. Furthermore, if the carbonitriding is carried out instead of the carburizing, more than 0.2 wt % of C is dispersed in the matrix in addition to the above-mentioned amount of C. Therefore, the resistance to the temper softening is improved and the strength of tooth surface is further improved.

The amounts of C, Si and Cr in a surface layer:

As a result of an investigation which was carried out in view of the fact that the strength of tooth surface against pitting and scoring depends on the resistance to the temper softening of the material, it has confirmed that in some cases a temperature of an engagement portion of gears is raised to about 300° C. under a high-contact pressure such as higher than 2000 MPa by Hertz's contact pressure. Therefore, the resistance to the temper softening were researched upon taking a temperature range to 300° C. into account. As a result of this research, we found that the resistance to the temper softening was remarkably improved while the forgeability and machinability of the material are maintained under a condition that an equation $5.5<3\times C$ (wt %)$+5.2\times Si$ (wt %)+Cr (wt %) was satisfied. Therefore, the amount of C, Si and Cr in the zone from surface to a depth of 0.1 mm is decided to satisfy the equation $5.5<3\times C$(wt %)$+5.2\times Si$(wt %)+Cr(wt %).

The amount of Mo and the amounts of Si, Mn, Cr and Mo:

It is known that when the steel including Si, Mn and Cr is treated by carburizing, such elements Si, Mn and Cr are oxidized by atmospheric gas (ambient gas) and imperfect hardened layers are formed at austenite grain boundary of the surface layer of the steel. This imperfect hardened layers lower a bending strength of tooth deddendum represented by an impact strength of the gear. Therefore, if a high bending strength is required, it is preferable to add Mo for preventing the increase of the imperfect hardened layers and for improving the toughness of the carbonized layer. However, Mo is expensive and degrades machinability of the material by excessive addition. Accordingly, the amount of Mo is decided to be within a range not more than 1.0 wt % if independently added. Furthermore, if an equation $7.5>2.2\times$ Si(wt %)$+2.5\times$Mn(wt %)+Cr (wt %)$+5.7\times$Mo (wt %) is not satisfied, the material forms bainite after normalizing or annealing. Therefore, the addition of the elements Si, Mn, Cr and Mo is decided to satisfy the equation $7.5>2.2\times$Si (wt %)$+2.5\times$Mn (wt %)+Cr (wt %)$+5.7\times$Mo (wt %).

The hardness at a depth of 50 μm from a surface:

The increases of surface hardness and of compression residual stress by shot peening suppress the generation and increase of fatigue cracks (failure) and improve the resistance to pitting and spalling. When the hardness at a depth of 50 μm from a surface is less than 700 Hv by Vickers hardness, the life-time to pitting is not sufficiently improved. When the hardness is more than 900 Hv, the toughness of the surface is lowered, and addendum and side edges of tooth tend- to generate defects during operations. Therefore, it is preferable to set the hardness within a range 700 to 900 Hv by Vickers hardness. Furthermore, in order to firmly ensure the above-mentioned merits, it is preferable to carry out the shot peening so as to keep the arc height within 0.4 min.

The roughness of the gear surface influences the distribution of microscopic contact-pressure and the lubrication condition such as thickness of oil film during the engagement of gears. Accordingly, this roughness is an important factor as to the strength of the tooth surface. Therefore, it is preferable to carry out shot peening by means of shots whose diameters are not larger than 0.7 mm.

The hardness at a depth of 50 μm from surface after grinding of tooth surface and the surface roughness:

It is well known that the strength of tooth surface depends on the accuracy of the gear and the assembly rigidity. A gear treated by surface-hardening generates strains through a heat treatment and lowers its dimensional accuracy. Therefore, the machining of the tooth surface for improving the dimensional accuracy and the surface roughness effectively improves the strength of the tooth surface. However, it is preferred that the hardness at a depth of 50 μm from surface is set at 700 to 900 Hv by Vickers hardness so as not to lower the surface strength by over grinding. Furthermore, it is preferable that the surface roughness is set to be not more than 5 μm in the maximum height (Rmax) and not more than 1 μm in the average height (Ra). These maximum height (Rmax) and average height (Ra) have been defined in JIS-B-0601.

PREPARATION OF SAMPLES

In order to evaluate the production method of the steel according to the present invention, Examples will be discussed in comparison with Comparative Examples, referring to Tables 1, 2 and 3.

Figure 3:
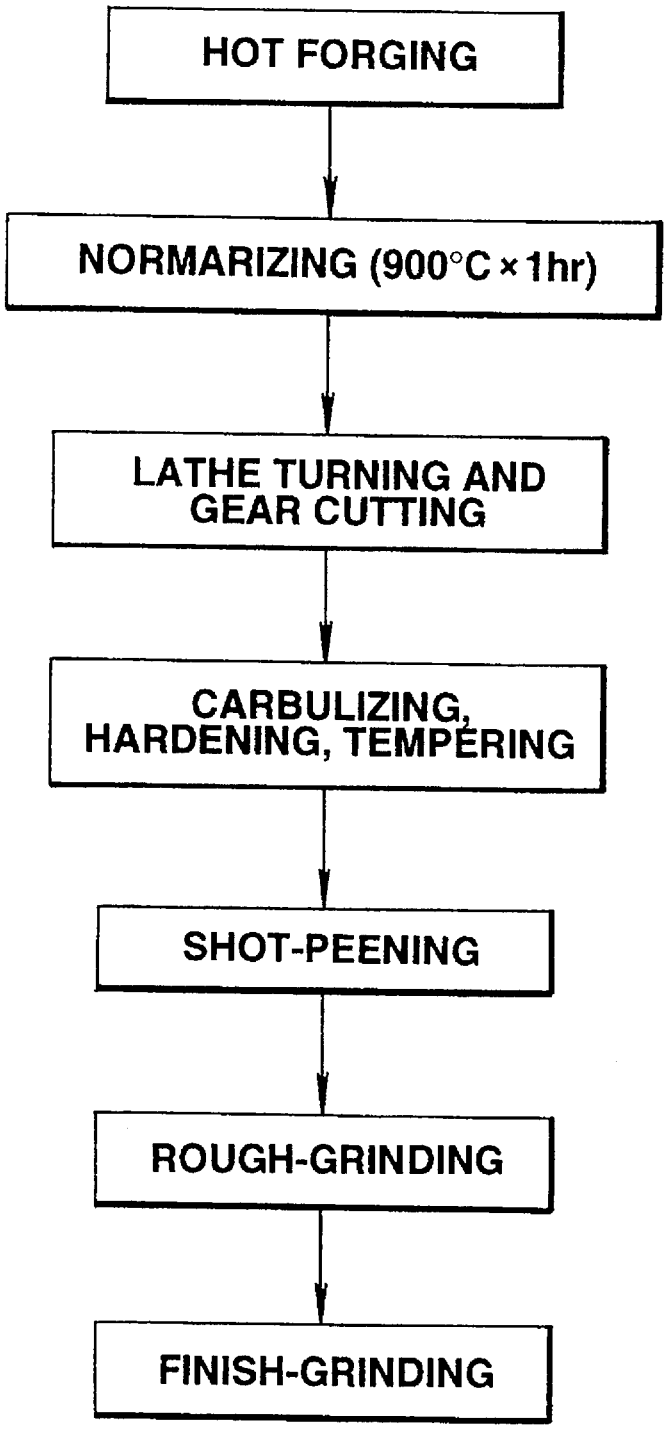
FIG. 3 is a flowchart which shows producing processes for tested gears.

As steel compositions according to the present invention, Compositions A to D shown in Table 1 were prepared, respectively. Further, Comparative compositions E to G were prepared as shown in Table 1.

accordance with the steps shown in FIG. 3, such as a hot forging, normalizing (900° C.×1h), a lathe turning, a gear cutting, carburizing-hardening-tempering or carbonitriding-hardening-tempering, a shot peening, a rough grinding, and a finish-grinding, in order to produce gears for a pitting-resistance test and gears for a repeated impact test shown in Table 2. As shown in Table 3, the produced Examples 1 to 14 of gears were differentiated from each other in composition and in production process.

Figure 4:
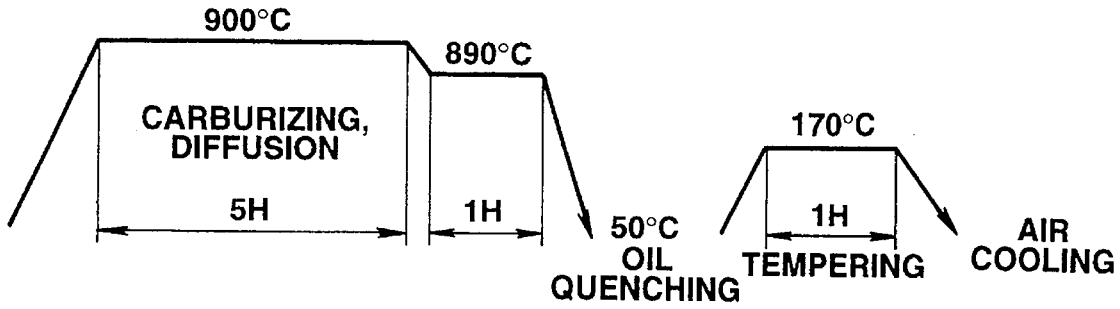
FIG. 4 is a time-chart which shows a heat treatment condition of carburizing-hardening-tempering applied to the examples according to the present invention.
Figure 5:
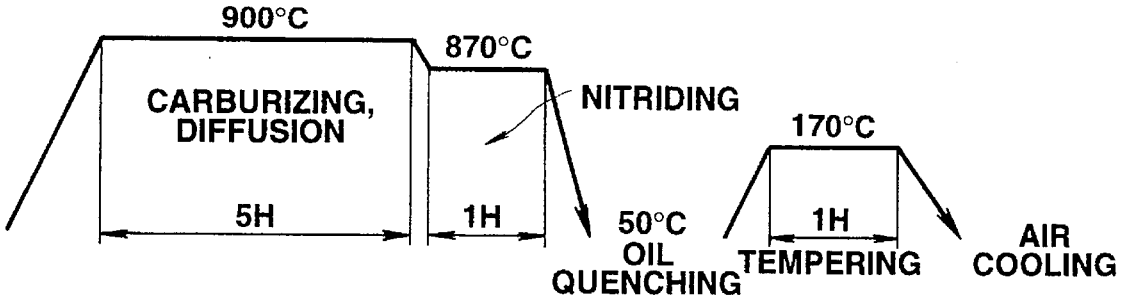
FIG. 5 is a time-chart which shows a heat treatment condition of carbonitriding-hardening-tempering applied to the examples according to the present invention.

FIG. 4 shows a condition of carburizing-hardening-tempering. FIG. 5 shows a condition of carbonitriding-hardening-tempering. The shot peening was carried out by a peening machine of an air-nozzle type and under a condition coverage 300% by using shots of HRC60 hardness and 0.7 mm diameter. The arc-height value of the shot peening was adjusted at more than 0.4 mm by changing an projection angle to a value shown in Table 3.

Furthermore, the grinding of tooth surface was carried out by using a Rice-Howell type grinder for rough-grinding and a Feslar type grinder for finish grinding. In both grinding, WA (fused alumina) grinding stone was used.

As shown in Table 1, it is noted that a comparative Composition E has a bad machinability since the hardness of the normalized material becomes remarkably high due to a high value of 2.2×Si(wt %)+2.5×Mn (wt %)+5.7×Mo (wt %) as compared with Compositions A to D according to the present invention.

The pair of gears which were produced to fit with a specification of Table 2 were used for a pitting-resistance test and a repeated impact test.

TABLE 1

| | | Chemical Composition (wt %) | | | | | | | | 2.2Si + 2.5Mn + | normalizing |
|---|---|---|---|---|---|---|---|---|---|---|---|
| | Composition | C | Si | Mn | Cr | Mo | P | S | Fe | Cr + 5.7Mo | (Hv) |
| Invention | A | 0.18 | 0.51 | 0.30 | 2.24 | — | 0.011 | 0.014 | balance | 4.1 | 155 |
| | B | 0.18 | 0.51 | 0.30 | 3.56 | — | 0.010 | 0.015 | ↑ | 5.4 | 164 |
| | C | 0.19 | 0.80 | 0.30 | 2.28 | — | 0.012 | 0.015 | ↑ | 4.8 | 160 |
| | D | 0.18 | 0.51 | 0.30 | 2.99 | 0.41 | 0.008 | 0.015 | ↑ | 7.2 | 172 |
| comparative | E | 0.80 | 0.30 | 3.01 | 0.82 | 0.009 | 0.014 | ↑ | 10.2 | 282 | |
| | F | 0.19 | 0.05 | 0.84 | 1.08 | 0.41 | 0.009 | 0.014 | ↑ | 5.6 | 175 |
| | G | 0.22 | 0.22 | 0.83 | 1.09 | — | 0.010 | 0.015 | ↑ | 3.6 | 159 |

Using the above materials of Compositions A to D, Examples 1 to 5 and 9 to 13 were prepared, as shown in Table 3. Further Comparative Examples 6 to 8 and 14 were prepared by using the materials of Compositions F and G, as shown in Table 3. These Examples were produced as follows.

Compositions A to G shown in Table 1 were melted and compositionally controlled, respectively. Then, each of Compositions A to G was cooled into an ingot and formed into gear material having 80 mm in diameter by means of a hot roll. Next, Compositions A to G were processed in

TABLE 2

| | For pitting test | For repeated impact test |
|---|---|---|
| Type of Gear | Helical Gear | Helical Gear |
| Module | 3.87 | 1.75 |
| Pressure Angle | 17.5° | 17.5° |
| Number of teeth | 21 | 42 |
| Twisted angle | 15° | 29° |
| Diameter of Pitch Circle | 84.1 mm | 84.0 mm |

TABLE 3

| Ex. No. | Comp. | Type | Heat treatment charateristics: Treatment | C (wt %) at surface | 3C + 5.25Si + C (wt %) | Arc Height (mm) | Finish processing: Finish Grinding | Rmax (μm) | Ra (μm) | Surface hardness (Hv) | Pitting Resistance | Abrasion Loss (μm) | Impact Strength (N · m) |
|---|---|---|---|---|---|---|---|---|---|---|---|---|---|
| 1 | A | Inv. | Carburizing | 0.86 | 7.47 | — | — | 6.75 | 0.962 | 735 | 3.6 | 8.3 | 884 |
| 2 | B | | ↑ | 0.95 | 9.06 | — | — | 5.37 | 1.03 | 771 | 4.8 | 4.1 | 863 |
| 3 | C | | ↑ | 0.95 | 9.29 | — | — | 5.12 | 1.13 | 773 | 4.1 | 6.7 | 902 |
| 4 | A | | Carbonitriding | 0.82 | 7.35 | — | — | 5.69 | 1.21 | 792 | 4.5 | 5.6 | 879 |
| 5 | D | | ↑ | 1.02 | 8.70 | — | — | 5.54 | 1.08 | 780 | 4.1 | 4.0 | 969 |
| 6 | F | Compa. | ↑ | 0.78 | 3.68 | — | — | 5.44 | 0.897 | 687 | 1.3 | 13.8 | 932 |
| 7 | G | | ↑ | 0.78 | 4.57 | — | — | 4.96 | 0.899 | 705 | 1.1 | 19.2 | 828 |
| 8 | G | | ↑ | 1.51 | 6.76 | — | — | 5.06 | 1.01 | 812 | 3.7 | 12.4 | 721 |
| 9 | A | Inv. | ↑ | 0.86 | 7.47 | 0.73 | — | 8.79 | 1.54 | 827 | 4.2 | 7.1 | — |
| 10 | A | Compa. | ↑ | 0.86 | 7.47 | 1.10 | — | 11.2 | 2.15 | 915 | 3.1 | 12.2 | — |
| 11 | A | Inv. | ↑ | 0.74 | 7.11 | 1.04 | Done | 1.53 | 0.162 | 752 | 4.7 | 3.5 | — |
| 12 | B | | ↑ | 0.76 | 8.49 | 1.04 | Done | 1.38 | 0.147 | 761 | 7.8 | 1.3 | — |
| 13 | C | | ↑ | 0.74 | 8.66 | 1.04 | Done | 1.39 | 0.144 | 774 | 5.2 | 3.2 | — |
| 14 | F | Compa. | ↑ | 0.72 | 3.50 | 1.04 | Done | 1.00 | 0.125 | 755 | 1,8 | 10.4 | — |

TEST METHOD

Figure 6:
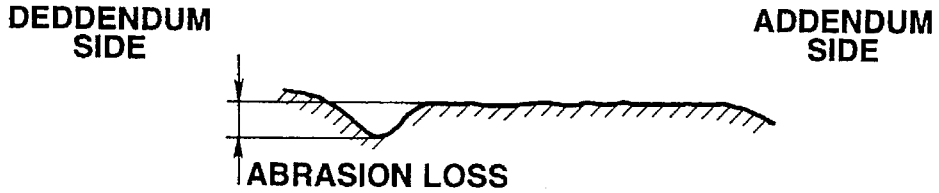
FIG. 6 is a view for explaining a measuring method of abrasion loss at tooth surface.

The pitting resistance test was carried out by using a gear fatigue tester of a motive-power circulation type under conditions where Hertz's contact pressure at a gear pitch point was 2019 MPa, a rotation speed of the gear was 1000 rpm, and oil for automatic transmissions was used as a lubrication oil in this test. The resistance to pitting was defined by total rotated numbers of the rotation of the tested gear when the area peeled by a pitting on the gear surface reaches 3% of an engagement effective area of all teeth of the gear. As to wear resistance, the amount of wear (abrasion loss) of tooth surface after 1 million rotations was measured as shown in FIG. 6.

Figure 7A:
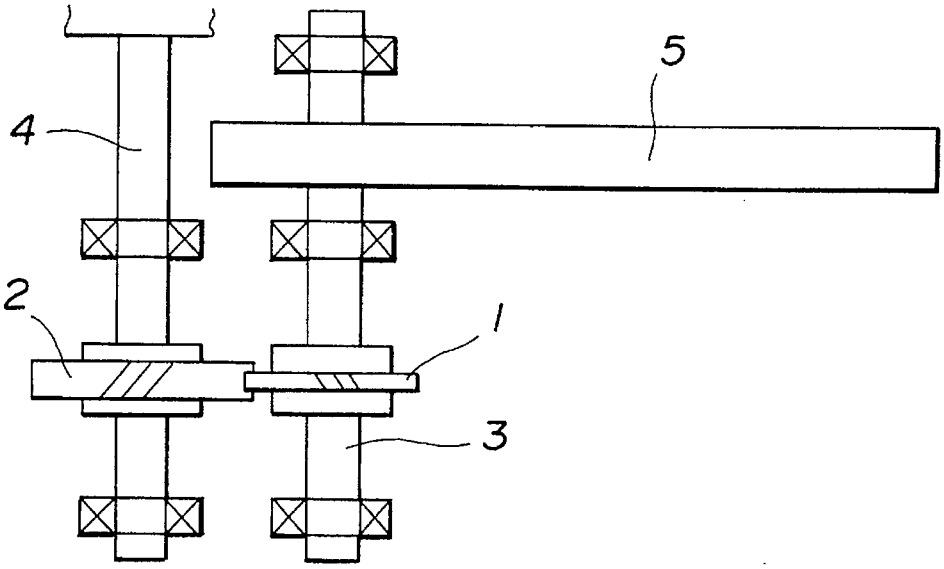
FIG. 7A is a top view of a repeated impact tester.
Figure 7B:
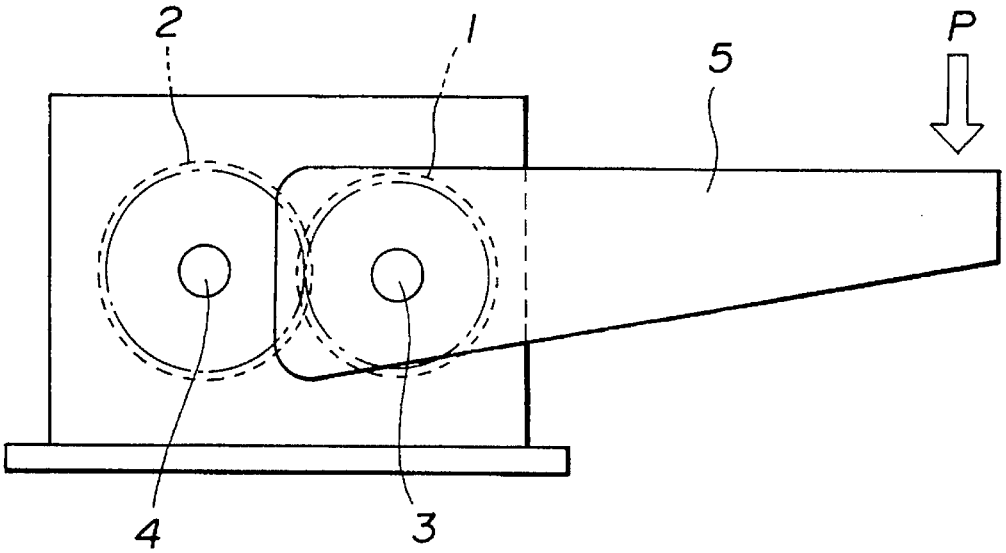
FIG. 7B is a side view of the repeated impact tester of FIG. 7A.

The repeated impact test was carried out by a repeated impact tester of a falling weight type. The tested gears 1 and 2 were set to an input shaft 3 and an output shaft 4, respectively while being engaged with each other as shown in FIG. 7. A torque arm 5 received an impact torque during the test by repeatingly falling a weight thereon. The life-time of this test was defined by a repeated number of the weight falling until the gear 1 was broken. The value of the impact torque was obtained by measuring a twisted torque of the output shaft 4. In this embodiment, the strength of the impact was defined as an impact torque by which the repeated number of the weight falling becomes 100.

TEST RESULTS

As clear from Table 3, Examples 1 to 5 exhibited a good properties as to pitting resistance and wear resistance by virtue of an improvement in the resistance to normalizing softening which was enabled by the adequate addition of Si and Cr. In particular, Example 5 is further improved in the impact strength by the adequate addition of Mo.

On the other hand, Comparative Examples 6 and 7 exhibited inferior pitting resistance and wear resistance since the added amounts of Si and Cr were too small. Example No. 8 was largely lowered in the impact strength though the life-time to pitting was relatively long, since the network-structure cementite was precipitated in the vicinity of the surface by virtue of the increase of carbon-potential during a carburizing.

Furthermore, Example 9 exhibited a good property in the tooth surface strength due to the improvements in the surface hardness by the shot peening. Comparative Example 10 exhibited a short life-time to pitting. Since Comparative Example 10 was treated by a severe shot peening, the roughness of the tooth surface was largely degraded and the hardness of the tooth surface is too large in addition to the increase of abrasion loss. Accordingly, the toughness at edge portions were degraded and defects of the tooth surface were generated.

Examples 11 to 13 were improved in the life-time of pitting since the dimensional accuracy and the surface roughness were improved by the grinding of the tooth surface. In contrast, Comparative Example 14 was not improved in the life-time although the grinding of the tooth surface was carried out.

What is claimed is:

1. A gear made of a steel which consists essentially of C ranging from 0.1 to 0.3% by weight, Si ranging not more than 1.0 % by weight, Mn ranging not more than 1.0% by weight, Cr ranging from 1.5 to 5.0% by weight, and balance including iron and an impurity;

said gear having a surface layer hardened by one of carburizing-hardening-tempering and carbonitriding-hardening-tempering, a zone from surface to a depth of 0.1 mm of the hardened surface layer including C ranging from 0.7 to 1.3% by weight and including C, Si and Cr so as to satisfy the following relationship: $5.5<3\times C$ (wt %)$+5.2\times Si$(wt %)$+Cr$(wt %).

2. A gear made of a steel which consists essentially of C ranging from 0.1 to 0.3% by weight, Si ranging not more than 1.0% by weight, Mn ranging not more than 1.0% by weight, Cr ranging from 1.5 to 5.0% by weight, Mo ranging not more than 1.0% by weight, and balance including iron and an impurity; wherein the following relationship is satisfied: $7.5>2.2\times Si$ (wt %)$+2.5\times Mn$ (wt %)$+Cr$ (wt %)$+5.7\times Mo$ (wt %);

said gear having a surface layer hardened by one of carburizing-hardening-tempering and carbonitriding-hardening-tempering, a zone from surface to a depth of 0.1 mm of the hardened surface layer including carbon ranging from 0.7 to 1.3% by weight and including C, Si and Cr so as to satisfy the following relationship: $5.5<3\times C$ (wt %)$+5.2\times Si$(wt %)$+Cr$(wt %).

3. A gear as claimed in claim 1, wherein a surface of said gear is treated by shot peening so that the hardness at a depth of 50 μm from surface is within a range from 700 to 900 Hv by Vickers hardness.

4. A gear as claimed in claim 1 wherein a surface of said gear is machined so that the hardness at a depth of 50 μm from surface is within a range from 700 to 900 Hv by Vickers hardness and that the roughness of the surface is formed so that a maximum height (Rmax) defined by JIS-B-0601 is within a range not more than 5 μm and that an average height (Ra) defined by JIS-B-0601 is within a rangel μm.

5. A method of producing a gear from a steel which consists essentially of carbon ranging from 0.1 to 0.3% by weight, silicon ranging not more than 1.0% by weight, manganese ranging not more than 1.0% by weight, chromium ranging from 1.5 to 5.0% by weight, and balance including iron and an impurity, said method comprising the steps of:

forming the steel into a gear-like shape by one of forging and machining; and hardening a surface layer of the shaped steel by one of carburizing-hardening-tempering and carbonitriding-hardening-tempering so that the surface layer from surface to a depth of 0.1 mm includes C ranging from 0.7 to 1.3% by weight and includes C, Si and Cr so as to satisfy the following relationship: $5.5<3\times C$ (wt %)$+5.2\times Si$(wt %)+Cr(wt %).

6. A method of producing a gear from a steel which consists essentially of C ranging from 0.1 to 0.3% by weight, Si ranging not more than 1.0% by weight, Mn ranging not more than 1.0% by weight, Cr ranging from 1.5 to 5.0% by weight, Mo ranging not more than 1.0% by weight, and balance including iron and an impurity, a relationship $7.5>2.2\times Si$ (wt %)$+2.5\times Mn$ (wt %)+Cr (wt %)$+5.7\times Mo$ (wt %) being satisfied, said method comprising the steps of:

forming the steel into a gear-like shape by one of forging and machining; and hardening a surface layer of the shaped steel by one of carburizing-hardening-tempering and carbonitriding-hardening-tempering so that the surface layer from surface to a depth of 0.1 mm includes C ranging from 0.7 to 1.3% by weight and includes C, Si and Cr so as to satisfy the following relationship: $5.5<3\times C$ (wt %)$+5.2\times Si$(wt %)+Cr(wt %).

7. A method as claimed in claim 5, further comprising a step of treating a surface of the shaped steel by shot peening so that the hardness at a depth of 50 μm from surface is within a range from 700 to 900 Hv by Vickers hardness.

8. A method as claimed in claim 6, further comprising a step of treating a surface of the shaped steel by shot peening so that the hardness at a depth of 50 μm from surface is within a range from 700 to 900 Hv by Vickers hardness.

9. A method as claimed in claim 5, further comprising a step of machining a surface of the shaped steel so that the hardness at a depth of 50 μm from surface is within a range from 700 to 900 Hv by Vickers hardness and that the roughness of the surface is formed so that a maximum height (Rmax) defined by JIS-B-0601 is within a range not more than 5 μm and that an average height (Ra) defined by JIS-B-0601 is within a range 1 μm.

* * * * *